United States Patent [19]

Patton

[11] 3,963,382

[45] June 15, 1976

[54] PORTABLE AIR CIRCULATING FAN

[76] Inventor: Noel Thomas Patton, 8227 Westridge Road, Fort Wayne, Ind. 46825

[22] Filed: Jan. 31, 1975

[21] Appl. No.: 546,089

[52] U.S. Cl. ..... 417/361; 415/121 G; 416/247 R; 417/234

[51] Int. Cl.[2] ..... F04B 49/10

[58] Field of Search ..... 417/361, 234; 415/121 G; 416/247

[56] References Cited

UNITED STATES PATENTS

| | | | |
|---|---|---|---|
| 2,123,448 | 7/1938 | Weber | 416/247 |
| 2,378,012 | 6/1945 | Herbster | 415/121 G |
| 2,498,968 | 2/1950 | Viewegh | 416/247 |
| 2,633,293 | 3/1953 | Jones | 417/361 |
| 2,857,095 | 10/1958 | Grau | 416/247 |
| 3,446,429 | 5/1969 | Suzuki et al. | 416/247 |
| 3,791,333 | 2/1974 | Losch | 416/247 |

*Primary Examiner*—C. J. Husar
*Attorney, Agent, or Firm*—Albert L. Jeffers; Roger M. Rickert

[57] ABSTRACT

A portable air circulating fan, especially a high velocity fan in which a rotary air impeller is mounted on the shaft of an electric motor while a guard is provided which encloses the impeller and may enclose part or all of the motor, and which guard is formed into separable forward and rearward sections. The electric motor for the fan is supported on one of the guard sections near the center, especially the rearward guard section, while a support frame is provided for the fan having a base portion and a pair of spaced upstanding legs which are connected to the sides of the guard, and about which points of connection the fan is tiltable. Advantageously, the legs are also connected to the rearward guard section but may, alternatively, be connected to the forward guard section. In this manner the rotating air impeller is guarded at all times.

The guard sections each comprise a center ring member and extending substantially radially from the center ring are wires which incline radially outwardly and inwardly to a peripheral outer ring. The radial wires may be provided with strengthening rings if desired.

9 Claims, 7 Drawing Figures

PORTABLE AIR CIRCULATING FAN

BACKGROUND OF THE INVENTION

Field of the Invention

The present invention relates to fans for moving air in occupied enclosures and the like, and is especially concerned with a fan of this nature which can be tilted or rotated about a horizontal axis so as to direct the air therefrom in different directions.

Portable fans for ventilating purposes, or for the purposes of merely moving air within an enclosure are known and quite often take the form of a support base on which the fan structure is mounted. Some of these fans are of the oscillating type and the fan moves back and forth on the support base, while others do not oscillate but are tiltable about a substantially horizontal axis on the support base.

The fans according to the prior art have involved certain expensive and cumbersome structures, particularly in respect of supporting the electric drive motor and the air impeller which support has been by a supporting member or by a connection to a spiral or ring guard construction. The drive motor is a rather heavy part of the fan structure. Heretofore, it has been thought desirable to connect the fan motor to the supporting base or to the spiral and/or ring guard in some manner in order to provide adequate support for the fan motor. This has led to certain operations in connection with the construction of the fan which are objectionable.

With the foregoing in mind, it is an object of the present invention to provide a ventilating or air circulating fan structure of the nature referred to in which the drawbacks that attended fan structures according to the prior art are avoided.

Another object of the present invention is the provision of a fan structure of the nature referred to having an electric motor driving an air impeller and a guard surrounding the fan in which the motor is supported by radial members in the guard structure, while the guard structure is, in turn, connected to a supporting base.

A still further object of the present invention is the provision of a high velocity type fan for moving air in which the guard is formed of substantially radial members that can be manufactured by automated equipment.

BRIEF SUMMARY OF THE PRESENT INVENTION

According to the present invention, an electric motor is provided having an output shaft and on the output shaft there is mounted a bladed air impeller which may be of a substantially conventional type. The motor and fan are disposed in a guard arrangement having radial members which consists of a forward section and a rearward section separable along a parting plane perpendicular to the axis of rotation of the air impeller.

Each guard section has a rim on the side facing the other and clips are provided which embrace the juxtaposed rims and hold the guard sections together in assembled relation. The guard structure comprises radial wires connected at the outer ends to the respective rims of the guard sections and extending inwardly and axially outwardly from the aforementioned parting plane toward the axis of rotation of the impeller. The rearward section of the guard in the center has a ring member fixed thereto and this ring member along with the radial wire provides the basis of support for the electric motor. The front section of the guard and which may be the mirror image of the rearward section may have a decorative cover panel mounted thereon in the center.

A support frame is provided for the fan structure for supporting the fan on the floor and the supporting frame structure comprises a base portion and spaced legs extending upwardly therefrom. The upper ends of the legs are pivotally connected at substantially diametrically opposite points to one of the forward and rearward sections of the guard and support the guard with the fan and fan motor supported therein for tilting about an axis extending perpendicularly to the axis of rotation of the fan impeller.

Advantageously, the legs are connected to the rearward guard section by means of rubber-like grommets, or the like, so that the fan will remain in the tilted position into which it is moved. The electric supply cable leading to the electric motor and the control switch for the electric motor may also be carried by one of the forward and rearward sections of the guard, advantageously the rearward section. The legs of the support frame are spaced far enough apart, that the fan can be tilted between the legs, thereby permitting the air from the fan to be directed in a number of directions.

The exact nature of the present invention and the several objects and advantages thereof will become more apparent upon reference to the following detailed specification taken in connection with the accompanying drawings, in which.

DETAILED DESCRIPTION OF THE INVENTION

Figure 1:
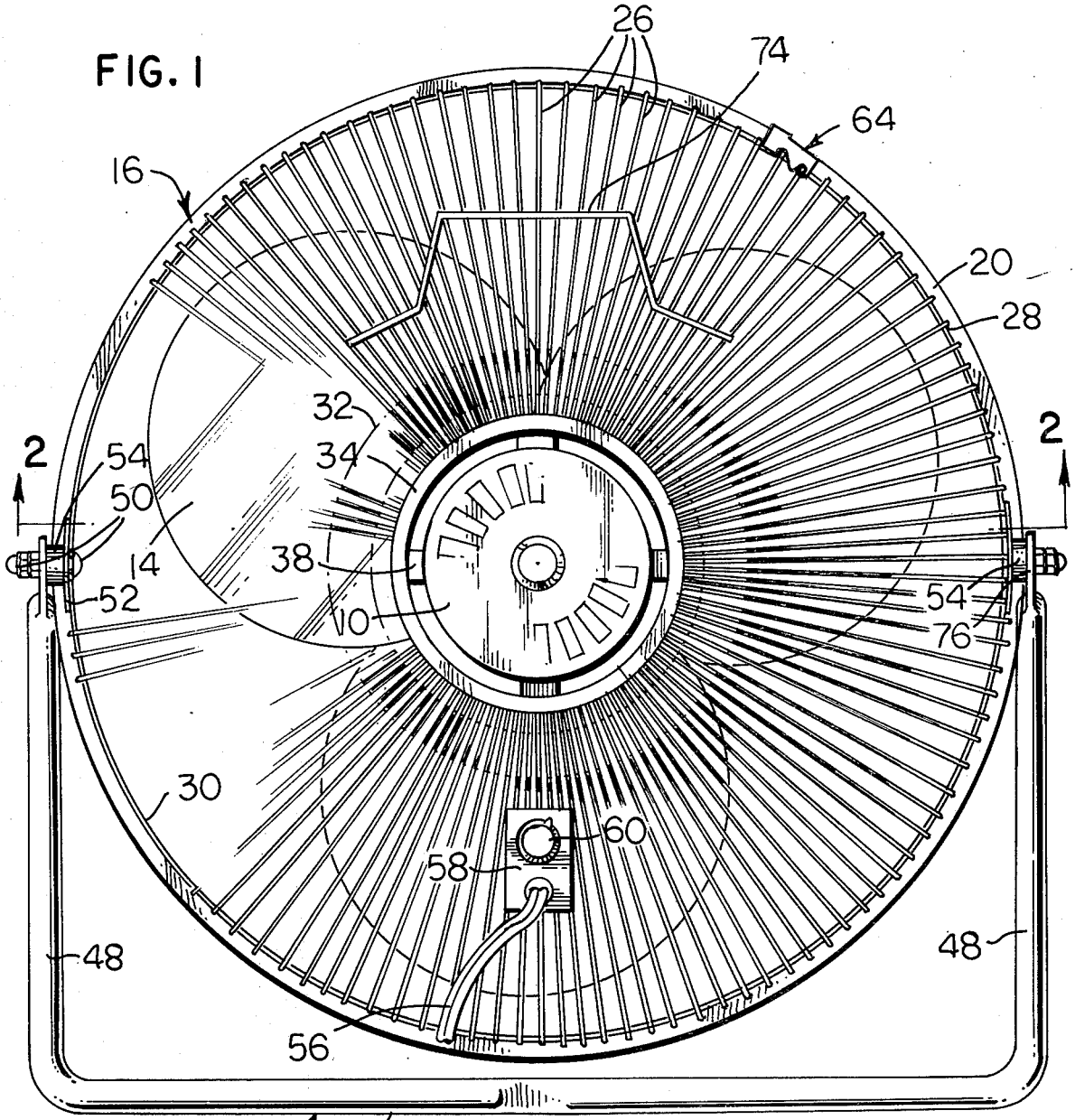
FIG. 1 is a rear elevational view of a fan structure constructed according to the present invention.
Figure 2:
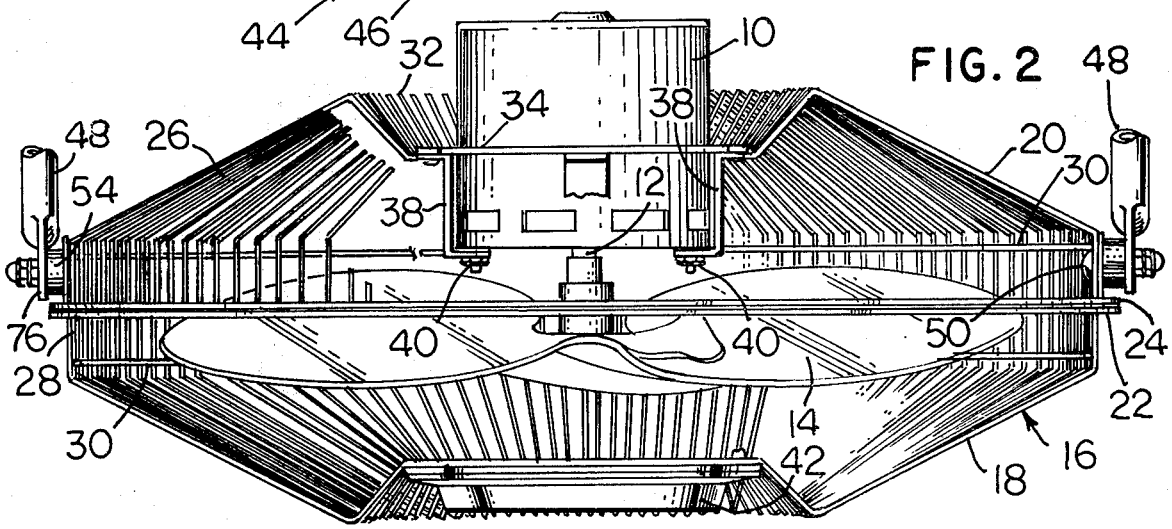
FIG. 2 is a transverse section indicated on line 2—2 of FIG. 1.
Figure 3:
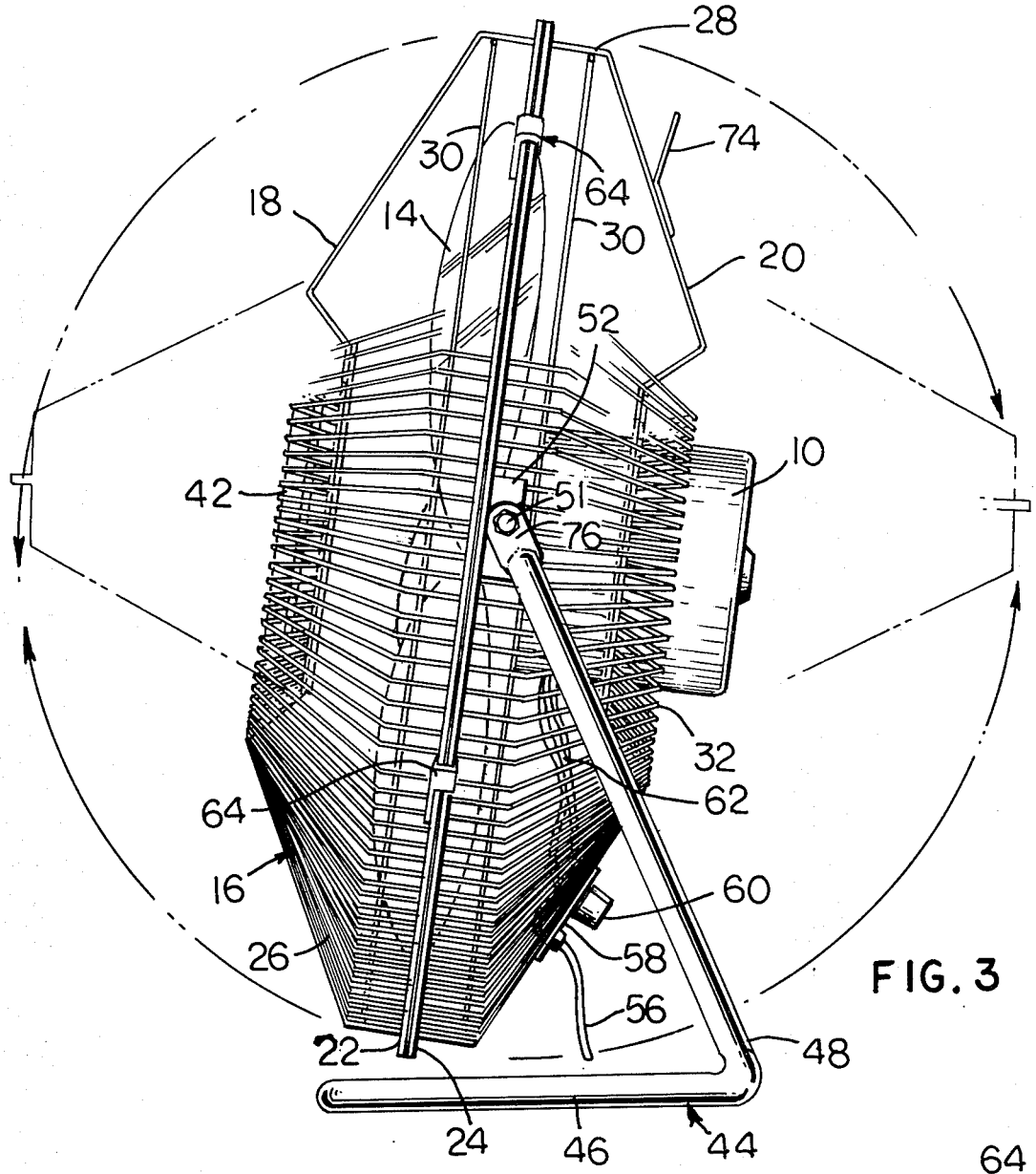
FIG. 3 is a side elevational view of the fan structure.

Referring to the drawings somewhat more in detail, and having particular reference to FIGS. 1, 2 and 3, the fan structure will be seen to comprise an electric motor 10 having an output shaft 12 on which a bladed air impeller 14 is mounted.

The motor and air impeller are surrounded by a guard structure, generally indicated at 16, and comprising a forward section 18 and a rearward section 20. Each of the forward and rearward sections 18, 20, comprises a respective peripheral rim 22, 24, on the side facing the other section of the guard and which rims are placed in juxtaposition when the guard is assembled. The forward and rearward sections of the guard are separable along the plane which falls between rims 22 and 24.

Each guard section comprises a plurality of circumferentially distributed radial wires 26 which at their one ends are connected to the respective rims and extend axially therefrom to a region 28 and at region 28 bend and extend toward the axis of rotation of impeller 14, while simultaneously diverging from the aforementioned plane of separability of the sections of the guard.

Axially spaced from each rim section there may be a wire ring 30 disposed inside the wires 26 making up the respective section and connected to the wires 26 for reinforcing purposes.

Radially inwardly from region 28 is another region 32 on each guard section where the wires 26 of the guard sections are bent inwardly so as to be in converging relation with the aforementioned plane. A short distance inwardly from region 32 the wires 26 terminate and have connected thereto an inner ring member 34 in respect of at least the rearward section 20 of the guard structure. The forward section 18 may have a similar ring member connected thereto whereby the forward and rearward sections of the guard with respect at least to the rim parts 22, 24 and the annular reinforcing wires 30, and the angles at which the wires 26 are bent and the aforementioned ring members can be identical.

The motor 10 is adapted for being supported on ring member 34 as by strap or wire elements 38 which have their forward ends bent over in the radially inward direction and connected to the motor frame as by nuts 40, while the rear ends of the straps are bent radially outwardly and are connected to ring member 34 by bolts, or are otherwise suitably affixed to the rearward guard section. The motor and the impeller driven thereby are, in the aforesaid manner, secured to and supported by the rearward guard section. The angular disposition of the various portions of the radial wires 26 making up the rearward guard section inhibit the transmission of vibration from the motor and provide for quiet, vibration free operation of motor 10 and impeller 14.

The forward guard section 18 which, as mentioned, may be substantially identical with the rearward guard section terminates in the center in a decorative cover plate member 42 secured to the forward guard section in the center in any suitable manner.

The fan structure comprises a supporting framework, generally indicated at 44, and which may comprise a horizontal base portion 46 and legs 48 upstanding therefrom in laterally spaced relation.

The upper ends of legs 48 are adapted for pivotal connection to the guard structure of the fan as by the bolts or thumb screws 50. Advantageously, either the forward guard section, or the rearward guard section, has plates 52 secured thereto adjacent the respective rim and at diametrically opposite points for engagement by the bolts 50. Plates 52 may be welded to the radial wires 26 of the respective guard section and there may be a similar plate provided on the inside of the wires for the purpose of strength and which plate may also be welded to the wires.

As will be seen in FIG. 2, a rubber-like grommet 54 is interposed between the upper end of each leg and the plate 52 so that when the bolt is tightened up and the grommet 54 is compressed, the fan assembly will be frictionally connected to the legs whereby the fan assembly, consisting of the guard structure and the fan motor and impeller, can be tilted about the axis defined by bolts 50, thereby permitting the air blast from the fan to be directed in a number of directions. The dot-dash outlines of the guard structure in FIG. 3, show various tilted positions to which the fan can be moved within the supporting framework 44.

The electric lead-in cable for supplying energy to the motor is indicated at 56 and this cable can lead through a suitable fitting 58 secured to the rearward section of the guard and which fitting includes therein a control switch 60. From switch 60 wires 62 lead to the fan motor and may provide for multiple speeds of operation thereof.

It has been mentioned that the guard structure is assembled by placing the respective rim parts in juxtaposition. When the rim parts are disposed in juxtaposition, the two sections making up the guard are interconnected by retaining clips 64 secured to the rim parts in embracing relation. There may be, for example, four or more such clips employed.

Figure 4:
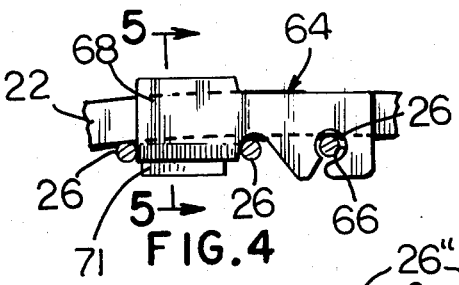
FIG. 4 is a fragmentary view showing one of the retaining clips which holds the two sections of the guard together.
Figure 5:
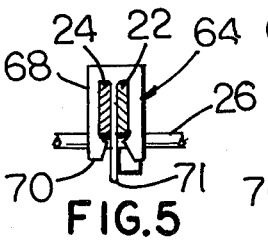
FIG. 5 is a vertical section indicated by line 5—5 on FIG. 4.
Figure 6:
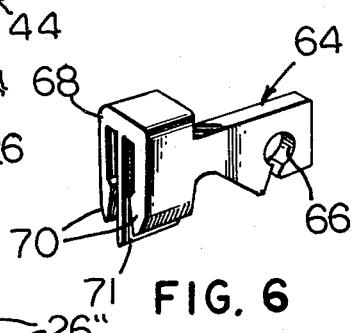
FIG. 6 is a perspective view of a typical retaining clip.

The exact nature of the connecting clips is better disclosed in FIGS. 4, 5 and 6. Each clip comprises a keyhole shaped aperture 66 adapted for snapping over a respective one of radial wires 26. When this portion of the clip is snapped over a radial wire 26 the clip can then be rotated downwardly and a U-shaped end part 68 will engage over the rims 22, 24 of the sections of the guard holding the rims together. Advantageously, the U-shaped portion 68 has the free ends of the legs thereof provided with knobs or protuberances 70 which serve to clamp the clip in place after it has been installed on the guard sections. A spacer 71 may be provided to separate the rims to provide a sound insulating function between the rims to thereby deaden vibrations and eliminating rattles. The opening into the keyhole slot is at an angle and portion 68 fits closely between adjacent ones of radial wires 26 whereby the retaining clip is prevented from becoming accidentally displaced from retaining position.

It will be evident that the radial wires 26 which form the forward and rearward sections of the guard structure extend radially and are closer together at the radially inner ends than at the radially outer ends. For relatively small fan structures it is not objectionable for the wires to be closer at the radially inner ends than at the radially outer ends because the wires can still be sufficiently close together at the radially outer ends to meet safety requirements. However, if the fan structure is rather large and the diameter of the guard structure becomes rather large, it can be the case that wires which are separated by a half inch at the radially outer ends form almost a solid mass near the center of the guard structure.

Figure 7:
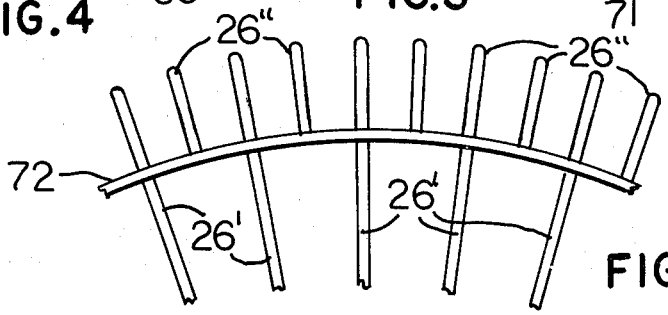
FIG. 7 is a fragmentary view showing a modification of the guard structure.

With this in mind, when the guard structure reaches a certain size it can be constructed as illustrated in FIG. 7, and wherein alternate ones of the wires 26' of the guard structure leading inwardly from the rim of the guard section terminate at an annular support member 72 which is in an intermediate region of the guard section. The others of the wires, indicated at 26'', however, extend completely to the central region of the respective guard section. In this manner, a circumferential spacing between the wires can be maintained which does not exceed about a half inch in any region of the guard structure while preventing the wires in the inward part of the guard structure from becoming crowded together and forming a substantially solid mass.

It has been mentioned that the fan structure is portable and with this in mind, either section of the guard may have a handle 74 affixed thereto so that the fan can be lifted and moved about.

The drawings show the supporting frame structure 44 pivotally connected to the rearward section of the guard, but it will be understood that the supporting frame structure could be pivotally connected to the forward portion of the guard structure if so desired. In any case, the legs 48 of the guard structure are spaced apart a sufficient distance that the guard structure together with the impeller and impeller drive motor can be tilted within the space between legs 48.

As will be seen in the drawings, the supporting frame 44 is preferably formed of tubular material and the upper ends of the legs are flatted, as indicated at 76, to form a region for engaging the grommets 54 and for receiving the bolts 50. It will be appreciated that the length of the grommets 54 can be selected to permit free tilting movement of the fan within the support frame 44 so that special configuring of the legs 48 of the support frame, in at least the upper regions thereof, is not required.

Modifications may be made within the scope of the appended claims.

What is claimed is:

1. In a fan having a rotary impeller, an electric drive motor having a shaft on which said impeller is mounted, a fan guard provided with radial members surrounding said impeller, said radial members carrying substantially the weight of the motor and impeller, said guard comprising forward and rearward sections separable along a plane substantially perpendicular to the axis of rotation of said impeller, said motor being connected to one of said sections of said guard, said support frame also being connected to one of said sections of said guard, each section of said guard having a rim at the side facing the other section, clip elements receivable over the juxtaposed rims of said sections to hold said sections together, each clip element comprising a bifurcated portion and spacer therebetween at one end to engage over said rims from the radially outer side and portion having a notch therein at the other end to engage over a radial member of at least one of the guard sections, each thus engaged radial member comprising a wire, and a support frame for said fan supportingly connected to said radial members.

2. A fan according to claim 1 in which the notch has an entrance opening smaller than a said wire and the free ends of the bifurcations at the one end of the clip element protrude toward each other, said clip element being formed of resilient material so as to snap into retaining position.

3. A fan according to claim 1 in which the notch has an angularly disposed entrance opening smaller than a said wire and the free ends of the bifurcations at the one end of the clip element protrude toward each other, said clip element being formed of resilient material so as to snap into retaining position, the said bifurcated portions and spacer being closely receivable between adjacent ones of the wires of said guard sections for locking the clip elements in place on said guard, said spacer providing sound insulation between the rims.

4. In a fan having a rotary impeller, an electric drive motor having a shaft on which said impeller is mounted, a fan guard provided with radial members supporting said impeller, said radial members carrying substantially the weight of the motor and impeller, wherein the guard is substantially circular when viewed in the axial direction of said impeller and comprises forward and rearward sections separable in a plane perpendicular to the axis of the impeller, each section comprising a peripheral rim on the side facing the other section and substantially radial wires connected at the outer ends to the respective rims and extending inwardly therefrom and inclined generally away from the said plane, a ring member connected to the wires of said rearward section coaxially with said motor, support means connecting said motor to said ring member, and securing means embracing the juxtaposed rims of said sections and holding said sections together, wherein each guard section includes an annular element connected to the radial wires thereof in an intermediate region of the respective guard section, certain ones of the wires leading from the rim of each section terminating at said annular element and the others of the wires continuing inwardly beyond said annular element, and a support frame for said fan supportingly connected to said radial members.

5. A fan according to claim 4 in which said radial wires of said rearward section are bent inwardly toward said plane in a circumferential region disposed outwardly from said ring member.

6. A fan according to claim 4 in which the radial wires of each section extend from the respective rims axially away from said plane and then toward the axis of the impeller while diverging from said plane.

7. A fan according to claim 4 which includes plate elements fixed to one of said guard sections adjacent the rim thereof at diametrically opposed points, said support frame comprising spaced legs, and bolts pivotally connecting the upper ends of said legs to said plate elements.

8. A fan according to claim 4 which includes friction creating grommet members interposed between said legs and said plate elements to hold the fan in tilted positions on said support frame.

9. In a fan having a rotary impeller, an electric drive motor having a shaft on which said impeller is mounted, a fan guard provided with radial members substantially free standing intermediate their ends, the guard surrounding said impeller and comprising substantially similar forward and rearward sections separable along a plane substantially perpendicular to the axis of rotation of said impeller, said motor being connected to one of said sections of said guard, said support frame also being connected to one of said sections of said guard, means connecting said sections of said guard to each other, said radial members carrying substantially the weight of the motor and impeller and spaced sufficiently close to one another to form a protective guard without the necessity for intermediate annularly disposed members, and a support frame for said fan supportingly connected to said radial members.

* * * * *